US009631833B2

(12) United States Patent
Arensmeier et al.

(10) Patent No.: US 9,631,833 B2
(45) Date of Patent: Apr. 25, 2017

(54) CLIMATE CONTROL SYSTEMS, AND METHODS RELATING THERETO

(71) Applicant: Emerson Electric Co., St. Louis, MO (US)

(72) Inventors: Jeffrey N. Arensmeier, Fenton, MO (US); Edward B. Evans, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 609 days.

(21) Appl. No.: 14/071,542

(22) Filed: Nov. 4, 2013

(65) Prior Publication Data

US 2014/0075967 A1 Mar. 20, 2014

Related U.S. Application Data

(63) Continuation-in-part of application No. 13/162,798, filed on Jun. 17, 2011, now Pat. No. 8,572,991.

(51) Int. Cl.

| | |
|---|---|
| ***F24F 13/22*** | (2006.01) |
| ***F24F 11/02*** | (2006.01) |
| *F24F 11/00* | (2006.01) |

(52) U.S. Cl.

CPC ..... *F24F 13/222* (2013.01); *F24F 11/02* (2013.01); *F24F 2011/0054* (2013.01)

(58) Field of Classification Search

CPC ... F24F 2011/0054; F24F 13/22; F24F 13/222
See application file for complete search history.

(56) References Cited

U.S. PATENT DOCUMENTS

| | | | | |
|---|---|---|---|---|
| 4,261,382 A | | 4/1981 | Bridges | |
| 4,464,582 A | * | 8/1984 | Aragaki | H02H 5/083 219/242 |
| 5,215,654 A | * | 6/1993 | Karterman | E02B 15/046 210/122 |
| 5,511,950 A | * | 4/1996 | Agata | B01D 3/106 137/391 |

(Continued)

OTHER PUBLICATIONS

"New Open Circuit Electronic Condensate Sensors", Resource Conservation Technologies;http://www.rctus.com/index.php?option=com_content&view=article&id=303&Itemid=311&lang=en; © 2009 Resource Conservation Technologies, Inc.; 1 page.

*Primary Examiner* — Len Tran
*Assistant Examiner* — Alexis Cox
(74) *Attorney, Agent, or Firm* — Harness, Dickey & Pierce, P.L.C.

(57) ABSTRACT

A climate control system includes a conditioning system for controlling air conditions of a space and a drain fitting coupling a condensate drain line to an air circulation unit of the conditioning system. The drain fitting includes multiple sensors configured to detect a water level in the air circulation unit relative to the drain fitting, and to output a signal to a controller indicative of contact with water. The controller is then configured to output a signal to a thermostat of the conditioning system upon determining that the water level is indicative of the drain line being plugged or blocked. The climate control system may also include a remote service provider system that allows remote interaction with the conditioning system.

16 Claims, 6 Drawing Sheets

(56) References Cited

U.S. PATENT DOCUMENTS

| | | | | |
|---|---|---|---|---|
| 5,522,229 | A * | 6/1996 | Stuchlik, III | E03C 1/28 340/620 |
| 5,755,105 | A | 5/1998 | Lacoste | |
| 5,854,518 | A | 12/1998 | Revis | |
| 6,976,367 | B2 | 12/2005 | Spanger | |
| 7,032,397 | B1 | 4/2006 | Mueller et al. | |
| 7,523,661 | B2 | 4/2009 | Dwyer et al. | |
| 7,774,102 | B2 | 8/2010 | Butler et al. | |
| 7,821,218 | B2 | 10/2010 | Butler et al. | |
| 7,821,411 | B1 | 10/2010 | Ward | |
| 8,494,681 | B2 | 7/2013 | Sartain et al. | |
| 2006/0045105 | A1 * | 3/2006 | Dobosz | H04L 12/2803 370/401 |
| 2006/0096638 | A1 * | 5/2006 | Coogle | F16L 55/07 137/268 |
| 2007/0062927 | A1 * | 3/2007 | Sells | F24C 15/327 219/401 |
| 2011/0019984 | A1 | 1/2011 | Glover | |
| 2012/0318381 | A1 | 12/2012 | Arensmeier | |
| 2013/0031921 | A1 * | 2/2013 | Hamada | F24F 13/22 62/155 |

* cited by examiner

CLIMATE CONTROL SYSTEMS, AND METHODS RELATING THERETO

CROSS-REFERENCE TO RELATED APPLICATION

This application is a continuation-in-part of U.S. patent application Ser. No. 13/162,798 filed on Jun. 17, 2011. The entire disclosure of the above application is incorporated herein by reference.

FIELD

The present disclosure relates to controls for controlling residential air conditioning and ventilation systems.

BACKGROUND

This section provides background information related to the present disclosure which is not necessarily prior art.

Climate control systems are typically utilized to maintain the temperature of a space relative to a set point by activating an air conditioning unit to cool the space. The air conditioning unit supplies sub-cooled refrigerant to an evaporator coil, which cools warm air from the space that is circulated across the evaporator coil. When the warm air contacts the colder surface of the evaporator coil, condensation of water can occur. The water condensation runs down the sides of the evaporator coil and collects in a condensate pan. The condensate pan has a condensate drain fitting and drain line attached thereto, which allows the water to drain from the condensate pan.

However, blockage in the condensate drain line can occur due to algae, fungus or bacterial growth forming particles that create restrictions in the drain line and can cause a clog. This will cause water to back up into the condensate drain pan. When the condensate pan is full of water, the water will overflow out of the pan and into the residential space, and potentially cause water damage to the residence. These flaws in condensate pan designs can also result in problems and/or damage to the air conditioning system.

SUMMARY

This section provides a general summary of the disclosure, and is not a comprehensive disclosure of its full scope or all of its features.

Example embodiments of the present disclosure generally relate to climate control systems. In one example embodiment, a climate control system generally includes a conditioning system for controlling air conditions of a space where the conditioning system includes a thermostat for controlling operation of the conditioning system, a drain fitting coupling a condensate drain line to an air circulation unit of the conditioning system to thereby allow condensate water to drain from the air circulation unit through the drain line, and a controller. The drain fitting includes multiple sensors configured to detect a water level relative to the drain fitting, and the controller is coupled to the sensors of the drain fitting. The sensors are configured to output a signal to the controller indicative of contact with water, and the controller is configured to output a signal to the thermostat upon determining that the water level is indicative of the drain line being plugged or blocked.

In another example embodiment, a climate control system generally includes a conditioning system for controlling air conditions of a space, a remote service provider system in communication with the conditioning system for controlling operation of at least part of the conditioning system, sensors associated with a condensate drain line of an air circulation unit of the conditioning system for detecting water level relative to the drain line, and a controller coupled to the sensors. The sensors are configured to output a signal to the controller indicative of contact with water, and the controller is configured to output a signal to the remote service provider system upon determining that the water level is indicative of the drain line being plugged or blocked.

Example embodiments of the present disclosure also generally relate to methods for operating climate control systems and their components. In one example embodiment, a method for operating a conditioning system for controlling air conditions of a space generally includes measuring water level in an air circulation unit of the conditioning system relative to a drain line of the air circulation unit using multiple sensors, determining if the drain line is plugged or blocked based on the number of sensors providing an output to a controller indicative of contact with water, communicating a fault signal to a thermostat of the conditioning system if the drain line is plugged or blocked, and instructing the conditioning system to at least partly shut down after the fault signal is communicated to the thermostat.

Various embodiments of a condensate fluid level sensor and drain fitting are also provided. In one embodiment, a combined fluid level sensor and drain fitting is provided. The fluid level sensor and drain fitting comprises a fitting body having a first annular end, a second external-threaded end with an opening therein, and a passage extending from the opening to the first annular end. The drain fitting further includes an array of sensors disposed on the second external-threaded end radially spaced around the opening such that at least two sensors are above the centerline of the opening. Each of the sensors are configured to provide an output that changes in response to contact with water, wherein the array of sensors are configured to detect a water level relative to the opening in the fitting body based on the number of sensors in the array that provide an output indicative of contact with water. The sensors are configured to detect a water level indicative of a clogged condensate drain when a majority of the sensors provide an output indicative of contact with water.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
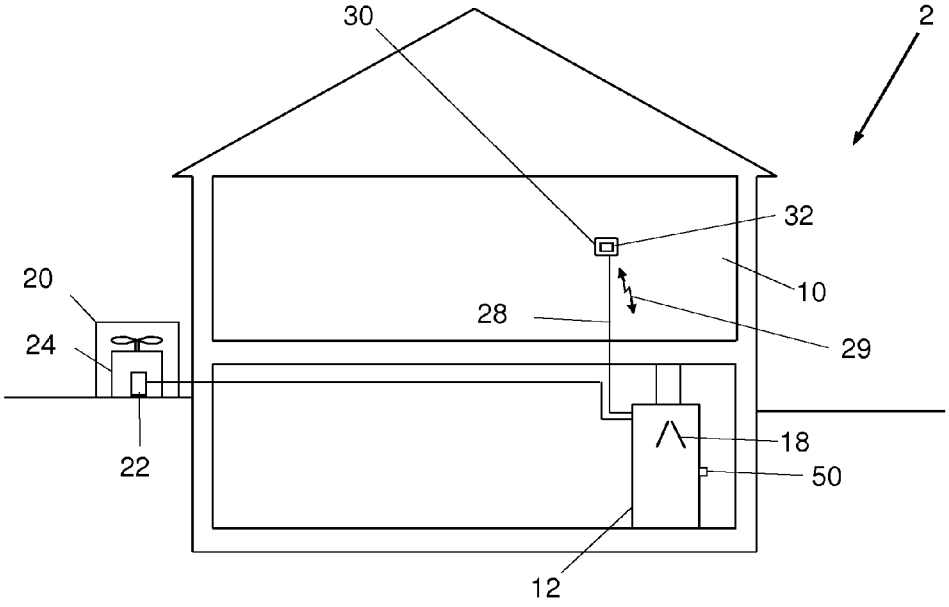
FIG. 1 is an illustration of a space having a climate control system including an air conditioning and/or heat pump system, in which one embodiment of a condensate fluid level sensor may be implemented in accordance with the principles of the present disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

According to one aspect of the present disclosure, a combined fluid level sensor and drain fitting is provided. The fluid level sensor and drain fitting comprises a fitting body having a first annular end, a second external-threaded end with an opening therein, and a passage extending from the opening to the first annular end. The fluid level sensor and drain fitting further includes a plurality of sensors disposed on the second external-threaded end radially spaced around the opening such that at least two sensors are above the centerline of the opening. Each of the sensors are configured to provide an output that changes in response to contact with water, wherein the plurality of sensors are configured to detect a water level relative to the opening in the fitting body based on the number of sensors in the array that provide an output indicative of contact with water.

The fluid level sensor and drain fitting are configured to detect a water level indicative of a clogged condensate drain line when a majority of the sensors provide an output indicative of contact with water. The plurality of sensors may be employed in a circuit including the sensors, which is configured to detect when a majority (or all) of the sensors provide an output indicative of water contact. In some embodiments, the fluid level sensor and drain fitting may be employed with a controller, where the controller is in communication with the output of the circuit and/or sensors, and is configured to communicate a signal indicative of a clogged condensate drain line based on the output of the plurality of sensors, as explained below.

According to another aspect of the present disclosure, a climate control system is provided. The climate control system generally includes a conditioning system for controlling air conditions of a space where the conditioning system includes a thermostat for controlling operation of the conditioning system, a drain fitting coupling a condensate drain line to an air circulation unit of the conditioning system to thereby allow condensate water to drain from the air circulation unit through the drain line, and a controller. The drain fitting includes multiple sensors configured to detect a water level relative to the drain fitting, and to output a signal to the controller indicative of contact with water. And, the controller is configured to output a fault signal to the thermostat upon determining that the water level is indicative of the drain line being plugged or blocked. The thermostat may then be operable to display a warning message upon receiving the fault signal from the controller, and may be further operable to at least partly shut down the conditioning system upon receiving the signal from the controller indicating that the drain line is plugged or blocked.

The climate control system may further include a remote service provider system in communication with the conditioning system and configured to monitor operational information of the conditioning system. Here, the controller may be configured to also output the fault signal to the remote service provider system. And, the remote service provider system may then operable to communicate the instructions to the thermostat to at least partly shut down the conditioning system upon receiving the fault signal. In addition, the climate control system may further include a user device in communication with the remote service provider system, where the remote service provider system may be operable to communicate an alert to the user device upon receiving the fault signal from the controller. The user device may then be operable to communicate instructions to the remote service provider regarding whether or not to shut down the conditioning system.

According to another aspect of the present disclosure, a method for operating a climate control system, and its components, generally includes measuring water level in an air circulation unit of the conditioning system relative to a drain line of the air circulation unit using multiple sensors, determining if the drain line is plugged or blocked based on the number of sensors providing an output to a controller indicative of contact with water, communicating a fault signal to a thermostat of the conditioning system if the drain line is plugged or blocked, and instructing the conditioning system to at least partly shut down after the fault signal is communicated to the thermostat.

The method may further include displaying a warning message on a display of the thermostat after the fault signal is communicated to the thermostat, thereby indicating to a user that the drain line is plugged or blocked. And/or, the method may further include communicating the fault signal to a remote service provider system, and the remote service provider system may then communicate instructions to the thermostat to at least partly shut down the conditioning system. And/or, the method may also include issuing an alert to a user indicating that the drain line is plugged or blocked, and then communicating instructions from the user to the remote service provider system to instruct the thermostat to at least partly shut down the conditioning system.

Example embodiments will now be described more fully with reference to the accompanying drawings.

Referring to FIG. 1, a climate control system 2 (broadly, a conditioning system) for conditioning a space 10 is shown. The climate control system 2 includes an indoor air circulation unit 12 having an evaporator coil 18 and an air conditioner unit 20 having a compressor 22 and condenser coil 24 for providing cooling operation. The climate control system 2 may be controllably operated by a thermostat 30 for the space 10. Warm air from the space 10 is circulated across the evaporator coil 18, in which a sub-cooled refrigerant removes heat from the air. When the warm air contacts the colder surface of the evaporator coil 18, condensation of water can occur. The water condensation is collected and drained through a fluid level sensor and drain fitting 50, as explained below.

Figure 2:
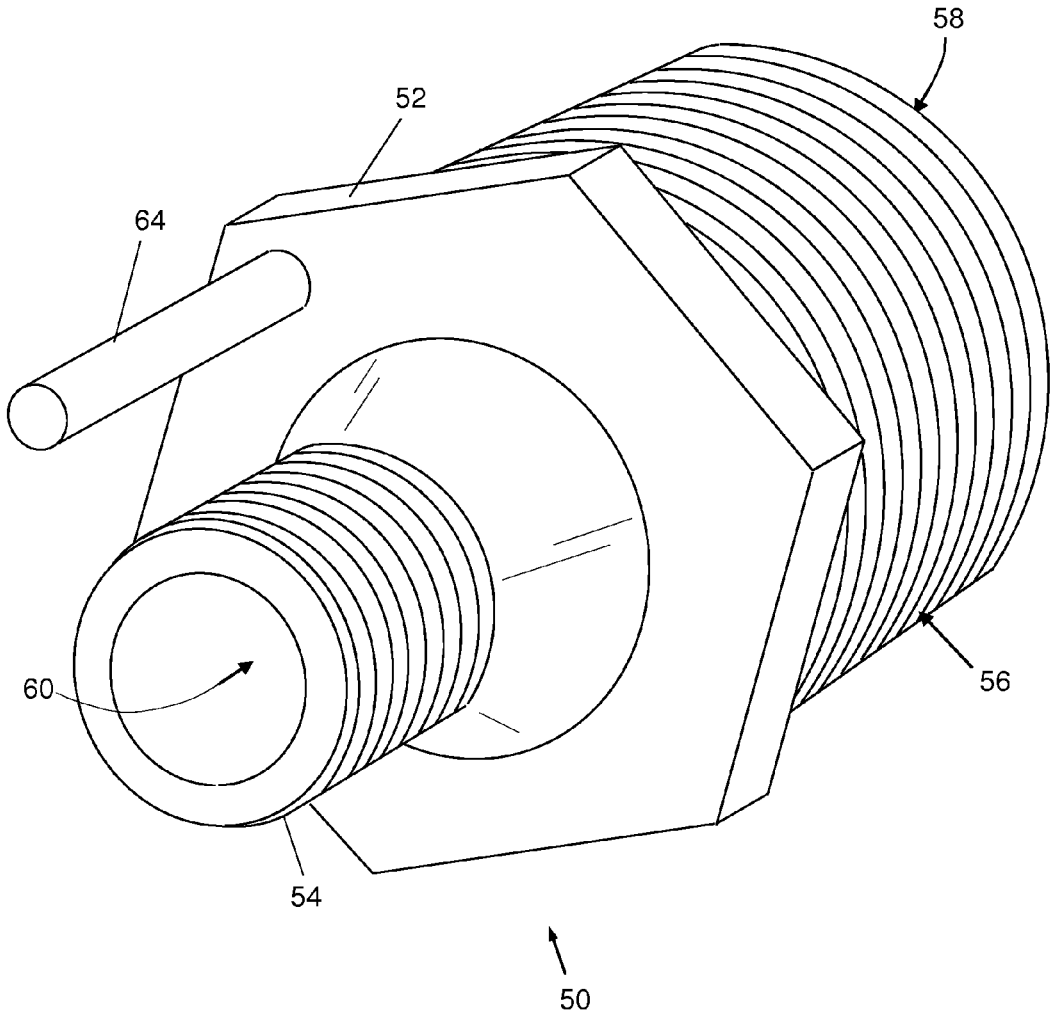
FIG. 2 is a front perspective view of one embodiment of a condensate fluid level sensor and drain fitting, in accordance with the present disclosure.

According to one aspect of the present disclosure, a fluid level sensor and drain fitting 50 for a condensate pan is provided as shown in FIG. 2. The fluid level sensor and drain fitting 50 enables draining of condensate water and detection of a clog in a condensate drain line. As shown in FIG. 2, the drain fitting 50 comprises a fitting body 52 having a first annular end 54, a second externally-threaded end 56 with an opening 58 therein, and a passage 60 extending from the opening 58 to the first annular end 54. The first annular end 54 may include a plurality of barbs (or alternatively threads) as shown in FIG. 2, for engaging the inside of a drain tube. The first annular end 54 may also be a pvc-type connection to be glued/secured inside a drain tube. The second external-threaded end 56 is configured to be installed and secured within an opening in a condensate pan (see FIG. 4). The fitting body 52 may further include a hex-shaped portion as shown in FIG. 2, for enabling connection of a wrench thereto, to aid in installation of the sensor and drain fitting 50.

Figure 3:
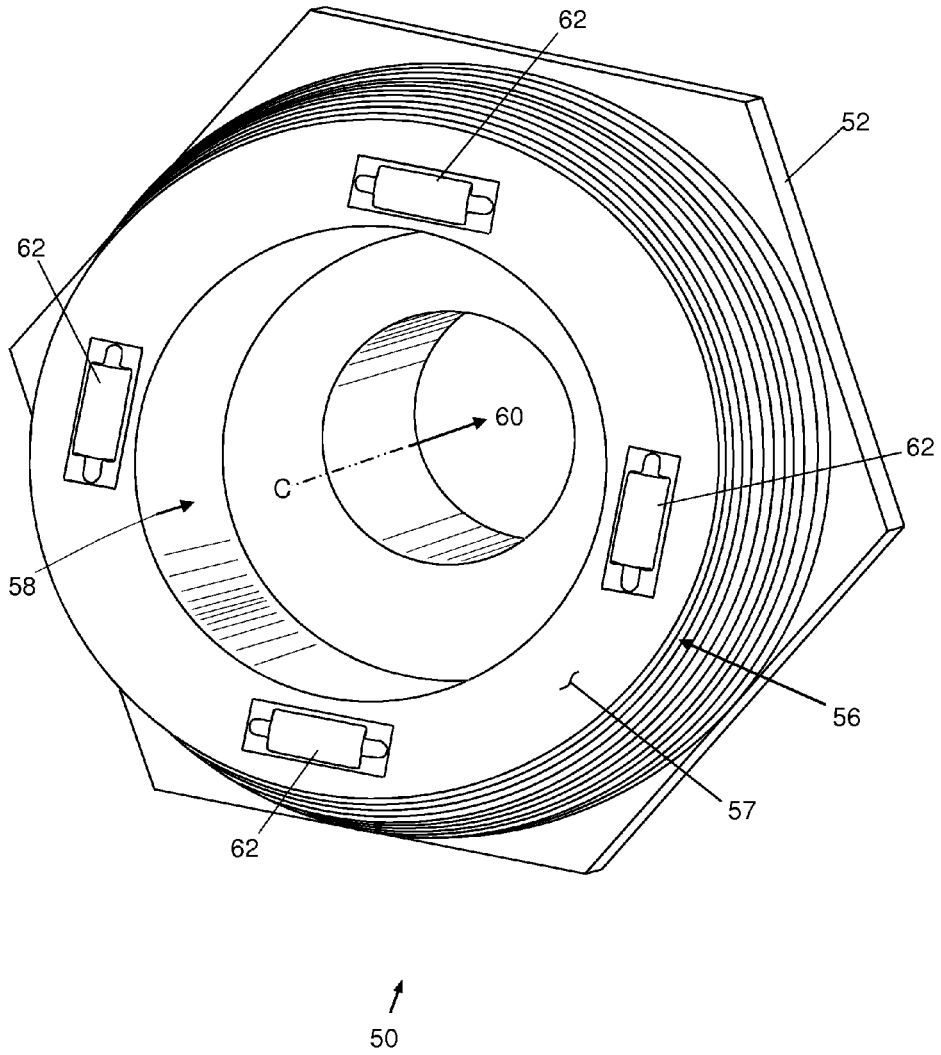
FIG. 3 is a rear perspective view of the condensate fluid level sensor and drain fitting in FIG. 2.

Referring to FIG. 3, the drain fitting 50 further includes a plurality of sensors 62 arranged in an array on a surface 57 of the second external-threaded end 56, being radially spaced around the opening 58 such that at least one sensor 62 is above the centerline C of the opening 58 regardless of the rotational position of the fitting. For example, where at least four sensors 62 are arranged in an array, the fitting 50 may be positioned such that two sensors 62 are above the centerline of the opening 58. Each of the sensors 62 are configured to provide an output that changes in response to contact with water, wherein the array of sensors 62 are configured to detect a water level relative to the opening 58 in the fitting body 52 based on the number of sensors 62 in the array that provide an output indicative of contact with water. The condensate fluid level sensor and drain fitting 50 are configured to detect a water level indicative of a plugged condensate drain line, based on the number of sensors 62 in the array that provide an output indicative of contact with water, as explained below.

The sensors 62 are configured to provide an output that changes in response to contact with or proximity to water. The sensors 62 may employ optics, a tuning fork, or conductivity to sense the presence of water. For example, the sensors 62 may be configured to employ conduction to sense water, where the resistance or associated output of the sensor 62 changes in response to contact with water. The embodiment in FIG. 4 employs thermal based sensors 62 that comprise thermistors, the resistance of which changes in response to conduction of heat to water that is proximate to or contacting the sensor 62. The sensors 62 may also be self-heating thermistors, or optionally heated by a separate resistor. The sensors 62 may be over-molded within the fitting body 52 or potted in place. The plurality of sensors 62 are electrically connected, via one or more wires 64 enclosed within the fitting body 52, to form part of an electrical circuit. Accordingly, the sensors 62 may be included in a circuit for providing an output indicative of the presence of water proximate the sensor 62.

Figure 4:
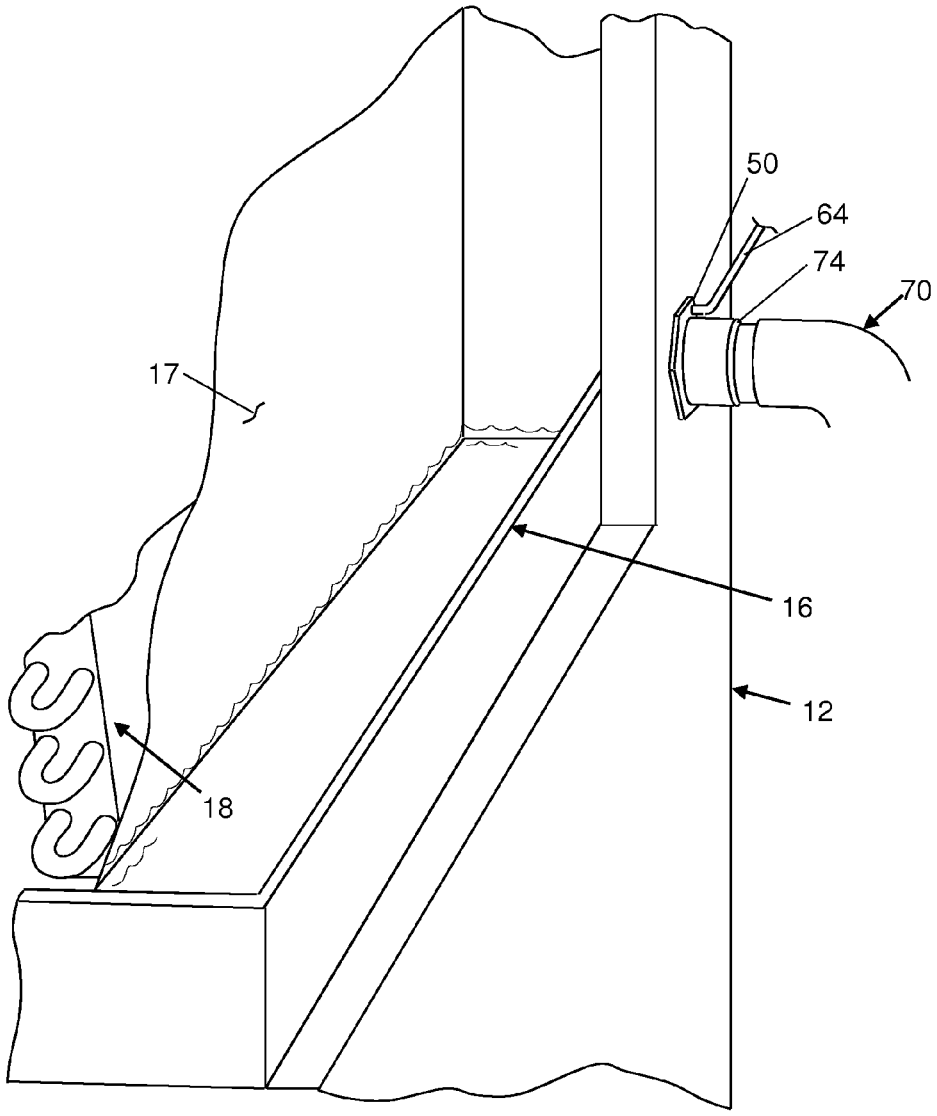
FIG. 4 is a perspective view of a portion of an evaporator coil and condensate pan of an air handling unit, shown with the condensate fluid level sensor and drain fitting installed.

Referring to FIG. 4, a perspective view is shown of a portion of an enclosed evaporator coil 18 in an air circulation unit 12 having a condensate pan 16 and a condensate fluid level sensor and drain fitting 50 installed therein. The sensor and drain fitting 50 is installed (via the external-threaded end 56 shown in FIGS. 2-3) within an opening in the side of the condensate pan 16, and may be disposed in close proximity to the evaporator coil 18 of the indoor air circulation unit 12. A condensate drain tube 70 may be secured (via a connector end 74) to the first annular end 54 of the sensor and drain fitting 50 (as shown in FIG. 2). The combined fluid level sensor and drain fitting 50 is configured to replace a conventional pipe fitting that is typically installed in the opening in the condensate pan. The sensor and drain fitting 50 includes a hollow passage 60 (FIG. 3), such that the drain path provided by the originally installed fitting is duplicated when the combined sensor and drain fitting 50 is installed.

When warm air contacts the colder surface of the evaporator coil 18, condensation of water occurs and collects in the condensate pan 16. If algae or bacterial growth forms a restriction that causes blockage in the condensate drain tube 70, condensate water will back up into the condensate drain pan 16. The resulting increase in water level in the condensate pan 16 can be detected by sensors, as explained below.

Installation of a stand-alone conventional sensor for sensing water in the condensate pan 16 would require removing a panel 17 (FIG. 4) to gain access for accurately positioning a sensor relative to the condensate pan 16 and routing wires around the panel 17. Unlike conventional sensors, the combined fluid level sensor and drain fitting 50 does not require removal of any panel 17, since it is installed within a drain opening in the condensate pan 16. This installation also positions the sensors 62 (FIG. 3) to enable detecting a water level indicative of a clogged drain tube 70 when a majority (or all) of the sensors 62 provide an output indicative of proximity to water.

Figure 5:
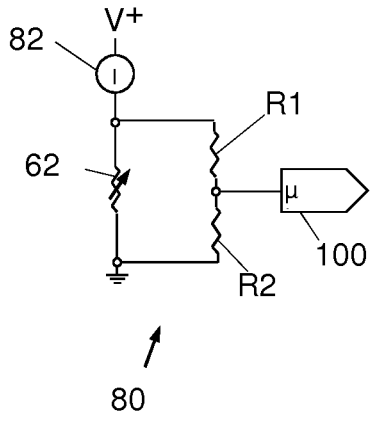
FIG. 5 is a schematic diagram of one embodiment of a circuit connection to the fluid level sensor for detecting a blocked drain line.

Referring to FIG. 5, a schematic diagram is shown of an electrical circuit 80 including a sensor 62 of the fluid level sensor and drain fitting 50 (as shown in FIG. 3). The electrical circuit 80 is configured to provide an output for the sensor 62 that is indicative of the presence of water proximate the sensor 62. The sensor 62 in FIG. 5 is a self-heating thermistor having a nominal resistance of 10 kiloohms that changes in response to water in proximity to or contacting the sensor 62. A voltage or current source 82 provides a 25 milliamp current that is supplied to the sensor 62. Any change in resistance of the sensor 62 results in a change in the voltage across the sensor 62, and the voltage across resistors R1 and R2. R1 and R2 divide the voltage to a value that is appropriate for input to a controller or input pin of a microprocessor 100, as shown in FIG. 5. Multiple instances of the single sensor electrical circuit 80 could be employed to form a circuit for providing one or more sensor outputs to a controller or microprocessor 100. The circuit would include an array of sensors 62, which could detect a water level indicative of a clogged condensate drain when a majority (or all) of the sensors 62 provide an output indicative of water in proximity to the sensors 62.

Figure 6:
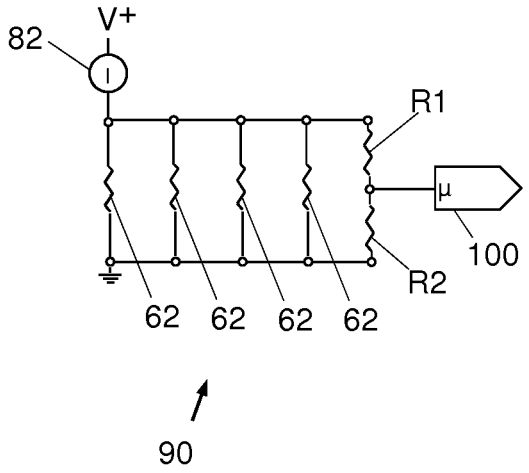
FIG. 6 is a schematic diagram of another embodiment of a circuit connection to the fluid level sensor for detecting a blocked drain line, in accordance with the present disclosure.

Referring to FIG. 6, a schematic diagram is shown of an electrical circuit 90 that includes multiple sensors 62. The electrical circuit 90 is configured to provide an output of a predetermined voltage level that is indicative of a clogged condensate drain 70 when a majority (or all) of the sensors 62 provide an output (e.g., a change in resistance) that is indicative of the presence of water proximate the sensor 62. The sensors 62 may be thermistors having a resistance that changes in response to water in proximity to the sensor 62, where a current source 82 is conducted to the sensors 62. A change in resistance in one sensor 62 will cause a change in voltage that is proportional to the change in total resistance of all the resistors/sensors 62 connected in parallel. Thus, the voltage across the four sensors 62 connected in parallel will not significantly change and reach a limit value until a majority (or all) of the sensors 62 are in contact with or proximity to water. The voltage across the four sensors 62 is also applied across resistors R1 and R2. R1 and R2 divide the voltage to a value that is appropriate for an input pin of a microprocessor 100, as shown in FIG. 6.

Accordingly, the sensors 62 may be included in an electrical circuit that is configured to provide an output indicative of a clogged condensate drain line when a plurality (or all) of the sensors 62 provide an output (e.g., a change in resistance) indicative of the presence of water proximate the sensors 62. The electrical circuit is configured to provide an output indicative of the water level to a controller or microprocessor 100, as explained below.

As shown in FIGS. 5-6, the electrical circuits are each configured to provide an output that may be received by a controller or microprocessor 100. Specifically, the output of the circuit (e.g., electrical circuits 80, 90) may be connected to an input pin of a microprocessor 100 or other comparable controller. In the circuit shown in FIG. 6, the microprocessor 100 is configured to receive the output (e.g. voltage across the sensors 62) and compare it to a reference value that is indicative of a clogged condensate drain line. Alternatively, the microprocessor 100 may be configured to receive the output of each sensor 62 (as shown in FIG. 5), and to determine the level of condensate water based on the number of sensors 62 that provide an output indicative of contact with or proximity to water. In either configuration, the controller or microprocessor 100 is further configured to output the communication of a technician service request upon detecting a water level indicative of a plugged condensate drain line. Such a communication may be received by a thermostat 30 and displayed on the display 32 of the thermostat 30 (FIG. 1). Alternatively, the controller may be part of a ClimateTalk™ enabled HVAC component that is configured to communicate via a ClimateTalk™ CT-485 port to an HVAC control, thermostat 30, or other HVAC device. Such ClimateTalk™ enabled controls and thermostats are manufactured by White-Rodgers, a Division of Emerson Electric Co. When utilized with such devices, the controller can send the communication of a technician service request to one or more ClimateTalk™ enabled devices for alerting a resident or even an HVAC repair service company, to remedy the problem before potential water damage to the residence occurs.

With reference again to FIGS. 1-4, in some aspects of the present disclosure the sensors 62 of the drain fitting 50 are configured to output a signal via a controller (e.g., via the microprocessor 100 (FIGS. 5 and 6), via controller 266 of climate control system 202 (FIG. 7, etc.), etc.) to the thermostat 30 when a water level indicative of a plugged condensate drain tube 70 and/or a flooded condensate pan 16 has been detected (e.g., a fault condition, etc.). This is done via telecommunications links (e.g., a hardwire connection 28 as shown in FIG. 1, a wireless connection 29 (e.g., using a Wi-Fi protocol, Bluetooth, z-wave, etc.) as shown in FIG. 1, etc.) between the controller of the sensors 62 in the drain fitting 50 and the thermostat 30. In so doing, the fault condition is communicated to the thermostat 30, and a warning message is shown on the display 32 and/or an alarm (e.g., an audible alarm, a visual alarm, etc.) is emitted from the thermostat 30 indicating to a user that action is required. In addition, in some further aspects, upon receiving the signal the thermostat 30 is further operable to shut down the climate control system 2 (e.g., turn off a fan of the air circulation unit 12, turn off the compressor 22 of the air conditioner unit 20, combinations thereof, etc.) to avoid potential water damage to the residence and/or the climate control system 2.

With that said, in some example embodiments the drain fitting 50 (and the controller for the sensors 62 of the drain fitting 50) may be a standalone aftermarket device configured to be installed in the climate control system 2 (e.g., where the climate control system 2 is a non-communicating system (e.g., where components of the system 2 do not directly communicate with each other, etc.), etc.). In this installation, the controller may be configured to communicate with the thermostat 30 via the wireless connection 29.

In other example embodiments, the controller for the sensors 62 of the drain fitting 50 may be provided as an integral part of the climate control system 2, for example, as part of an indoor unit controller (e.g., an air handler controller, an integrated furnace controller, etc.), etc. Here, the controller for the sensors 62 of the drain fitting 50 may be configured to communicate with the thermostat 30 via the hardwire connection 28. Further, in some aspects, the components of the climate control system 2 (e.g., the air circulation unit 12, the air conditioner unit 20, the sensors 62, the thermostat 30, etc.) may be part of a ClimateTalk™ system (from White-Rodgers, a Division of Emerson Electric Co.) that provides a communication protocol (e.g., running on RS-485 hardware layer, etc.) allowing the components to communicate with each other for use in controlling operation of the climate control system 2 and the components. A further description of the ClimateTalk™ protocol is provided in Applicant's co-owned U.S. Pat. Nos. 7,774,102 and 7,821,218, both of which are incorporated herein by reference.

Figure 7:
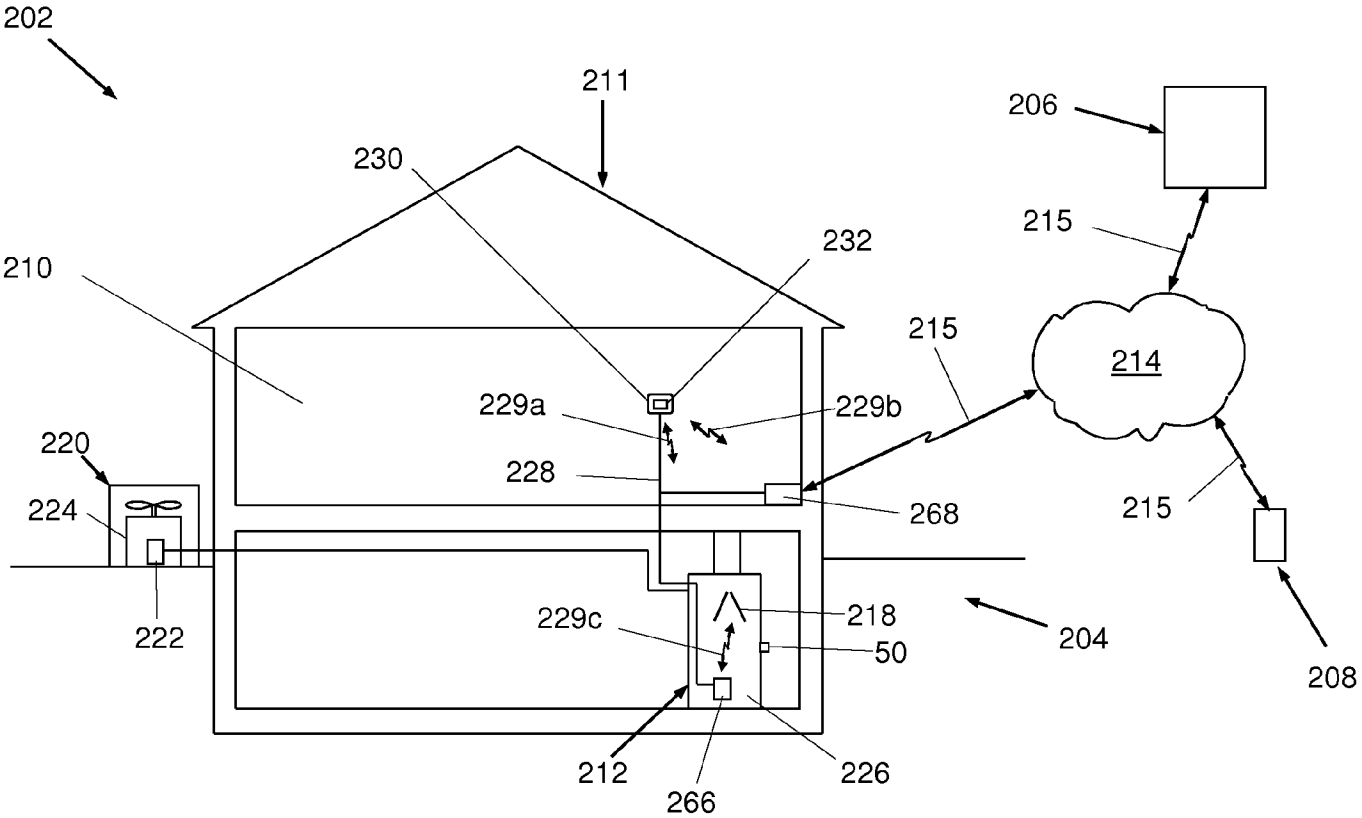
FIG. 7 is an illustration of a space having a climate control system according to another example embodiment of the present disclosure.

With additional reference now to FIG. 7, a climate control system according to another example embodiment of the present disclosure is shown generally at reference number 202. The illustrated system 202 generally includes a heating, ventilation, and air conditioning (HVAC) system 204 (broadly, a conditioning system), a remote service provider system 206, and a user device 208. In general, the HVAC system 204 operates to condition (e.g., control temperature of, control moisture content of, etc.) a space 210 of a structure 211. And, the service provider system 206 and the user device 208 operate to allow remote interaction with and/or operation of the HVAC system 204. These operations will be described in more detail hereinafter.

In the illustrated embodiment, the HVAC system 204, the service provider system 206, and the user device 208 are in communication (e.g., one-way communication, two-way communication, etc.) with each other via a network 214, using suitable telecommunications links 215 (e.g., hardwired links, phone lines, wireless links, wireless transceivers, network links, internet, internet and user accounts, intermediary components, combinations thereof, etc.). The network 214 can include any suitable network such as, for example, the Internet, an intranet, an internet, one or more separate or shared private networks, one or more separate or shared public networks, wired networks, wireless networks, etc. In addition, it should be appreciated that network systems (and their components), such as the HVAC system 204, the service provider system 206, and the user device 208 described herein, may include hardware and/or software for transmitting and/or receiving data and/or computer-executable instructions over the telecommunications links 215, and memory for storing such data and/or computer-executable instructions. In addition, processors may also be provided for processing the data and/or executing the computer-executable instructions as needed, as well as other internal and/or peripheral components.

As shown in FIG. 7, the HVAC system 204 generally includes an air circulation unit 212 and an air conditioner unit 220. The air circulation unit 212 includes a furnace component 226 for providing heating operation to the space 210. The air circulation unit 212 also includes an evaporator coil 218, and the air conditioner unit 220 includes a compressor 222 and condenser coil 224 for providing cooling operation to the space 210. In general heating operation, the furnace component 226 of the air circulation unit 212 heats air from the space 210, and a fan of the air circulation unit 212 then circulates the heated air through the space 210. In general cooling operation, warm air from the space 210 is circulated across the evaporator coil 218, in which a subcooled refrigerant removes heat from the air. When the warm air contacts the colder surface of the evaporator coil 218, condensation of water occurs. The water condensation is collected in a drain pan (e.g., the condensate pan 16 in FIG. 4, etc.) of the air circulation unit 212 and drained through a condensate drain line (e.g., the condensate drain tube 70 in FIG. 4, etc.) coupled to the air circulating unit 212 (e.g., as shown in FIG. 4, etc.) for disposal.

A thermostat 230 is provided to control operation of the HVAC system 204, including the air circulation unit 212 and the air conditioner unit 220, for controlling air conditions of the space 210. And, in some aspects (while not required), sensors may be associated with various ones of the components of the HVAC system 204 (e.g., the air circulation unit 212, the air conditioner unit 220, the thermostat 230, etc.) to monitor desired operational parameters of the system 204 (e.g., status data of the HVAC system 204, operational data of the HVAC system components (e.g., status, efficiency, connectivity, deterioration, current, voltage, etc.), air temperature of the space 210, humidity of the space 210, fault events/conditions for the HVAC system components (e.g., line blockages, motor failures, circuit failures, fluid level failures, etc.), service data for the HVAC system components, etc.) (e.g., as part of a ClimateTalk™ system, etc.). Here, the sensors may be operable to output (via controllers) information associated with the operational parameters (e.g., status, fault conditions, etc.) of the components to the thermostat 230, the service provider system 206, and/or the user device 208, as desired. It should be appreciated that the controllers associated with the sensors can include any suitable processor-driven devices for controlling communication of signals from the sensors, and may comprise components such as processors, memory, input/output interfaces, network interfaces, etc.

The service provider system 206 is configured to communicate (via the network 214) with the HVAC system 204 to collect, monitor, process, etc. the operational information relating to the various components of the HVAC system 204 and, as needed, to provide instructions to the HVAC system 204 relating to control of the system 204. The service provider system 206 and the user device 208 are then configured to communicate (also via the network 214) to allow a user (e.g., a homeowner, a technician, etc.) access to the collected operational information. In some aspects, the service provider system 206 is also configured to provide various communications to the user (e.g., solicited from the user, unsolicited from the user, etc.) regarding, for example, status checks/updates for the HVAC system 204, fault conditions/events for HVAC system components, HVAC system service requests/needs, technician information, etc. In addition, in some further aspects, the service provider system 206 is also configured to receive input from the user (via the user device 208) regarding the control of the HVAC system 204 (e.g., instructions to change operational parameters of the HVAC system components, instructions for responding to fault conditions of the HVAC system components, instructions regarding service requests for the HVAC system components, etc.). Further, in some aspects of the present disclosure, the user device 208 may be configured to communicate directly with the HVAC system 204 (e.g., with the thermostat 230, with the controllers of the sensors of the HVAC system 204, with controllers associated with the various components of the HVAC system 204, etc.) so that the user can directly receive and/or transmit information from/to the HVAC system 204 relating to operation, control, etc. In addition, it should be appreciated that while one user device 208 is illustrated in FIG. 7, multiple user devices (for multiple homeowners, technicians, etc.) may be in communication with the service provider system 206 and/or HVAC system 204 via the network 214 within the scope of the present disclosure.

The service provider system 206 may include any suitable components, features, etc. that allow it to communicate with the HVAC system 204 and/or the user device 208, such as computers, servers, etc. For example, a web portal interface may be provided to allow the user to access the service provider system 206 (e.g., via an Internet website or portal using a customer username and password, etc.) to locate the desired HVAC system 204, and then to allow the user to access the operational information for the HVAC system 204 and/or provide instructions regarding operation, control, etc. of the HVAC system 204. One or more databases may also be provided for storing the user account information (e.g., access information for the web portal interface such as the customer username and password, contact information for the user device 208 (e.g., e-mail address, phone number, etc.), etc.), the operational information for the HVAC system 204, etc.

The user device 208 may also include any suitable device that allows the user to communicate with the HVAC system 204 and/or the service provider system 206. As an example, the user device 208 may include a computer (e.g., a desktop computer, a laptop computer, a netbooks, etc.), a tablet (e.g., an iPad™, etc.), a smart phone (e.g., an iPhone™, an Android phone, etc.), etc. Further, the user device 208 may include program modules that allow it to interact with the service provider system 206, for example, via the web portal interface, etc.

An example interaction of the HVAC system 204, the service provider system 206, and the user device 208 will be described next. In the illustrated climate control system 202, the air circulation unit 212 of the HVAC system 204 includes the fluid level sensor and drain fitting 50 previously described herein (see, e.g., FIGS. 1-4, etc.) for coupling the condensate drain line to the air circulation unit 212 (adjacent the drain pan) (e.g., as an integral part of the HVAC system 204, as an after-market add-on to the HVAC system 204, etc.). The drain fitting 50 also includes the sensors 62 previously described herein (see, e.g., FIGS. 1-4, etc.), which are operable to sense, detect, etc. water level relative to the drain fitting 50 and/or condensate drain line (as such, the sensors 62 of the drain fitting 50 may also be viewed as associated with the condensate drain line). The sensors 62 are coupled to a controller 266, and are configured to output a signal to the controller 266 indicating whether or not they are in contact with water. And, the controller 266 is configured to determine if the signals received from the sensors 62 are indicative of a fault condition in the air circulation unit 212 (e.g., a water level indicative of a plugged/backed-up condensate drain line, a water level indicative of a flooding of the drain pan, etc.). If such a fault condition is detected/determined, the controller 266 is then operable to communicate a corresponding fault signal to the thermostat 230

(e.g., via hardwire connection 228 if the drain fitting 50 and controller 266 are an integral part of the HVAC system 204 (e.g., part of a ClimateTalk™ system, etc.), via a wireless connection 229*a* (e.g., using a Wi-Fi protocol, Bluetooth, z-wave, etc.) if the drain fitting and controller 266 are an aftermarket installation in the HVAC system 204, etc.), as well as to the service provider system 206 and/or the user device 208 (via the hardwire connection 228, a gateway 268, the telecommunications links 216, and the network 214 if the drain fitting 50 and controller 266 are an integral part of the HVAC system 204 (e.g., part of a ClimateTalk™ system, etc.); via a wireless connection 229*c* (e.g., using a Wi-Fi protocol, Bluetooth, z-wave, etc.), the gateway 268, the telecommunications links 216, and the network 214 if the drain fitting and controller 266 are an aftermarket installation in the HVAC system 204, etc.), as desired.

In this example, when the fault condition is detected in the HVAC system 204, the controller 266 communicates the corresponding fault signal to both the thermostat 230 and the service provider system 206 (as described above). In so doing, a warning message is shown on a display 232 of the thermostat 230 and/or an alarm (e.g., an audible alarm, a visual alarm, etc.) is emitted by the thermostat 230 indicating to a user that action is required. In addition, an alert is issued by the service provider system 206 to the user device 208 (e.g., an e-mail, a short message service (SMS), a phone call, etc.) alerting the user of the fault condition and indicating that service/action is needed. As part of alerting the user, the service provider system 206 may also request instructions from the user as to whether the HVAC system 204 should be shut down (e.g., via a "yes/no" response, etc.). If the user responds in the affirmative (e.g., with a "yes" response, etc.), the service provider system 206 then also issues instructions to the thermostat 230 to shut down the HVAC system 204 (e.g., turn off the fan of the air circulation unit 212, turn of the compressor 222 of the air conditioner unit 220, combinations thereof, etc.) to avoid potential water damage to the structure 211 and/or the HVAC system 204. Alternatively, in some example embodiments, the service provider system 206 may immediately issue instructions to the thermostat 230 to shut down the HVAC system 204 (as described above) upon receiving the fault signal from the controller 266 (without requesting instructions from the user). And, in some example embodiments, the thermostat 230 may immediately shut down the HVAC system 204 (as described above) upon receiving the fault signal from the controller 266 (without waiting for instructions from the service provider system or user).

With that said, in some example embodiments the drain fitting 50 (and the controller 266 for the sensors 62 of the drain fitting 50) may be a standalone aftermarket device configured to be installed in the HVAC system 204 (e.g., where the HVAC system 204 is a non-communicating system (e.g., where components of the HVAC system 204 do not directly communicate with each other, etc.), etc.). In this installation, the controller 266 may be configured to communicate with the thermostat 230 via the wireless connection 229*a*. Further, the thermostat 230 may be configured to communicate with the service provider system 206 and/or the user device 208 via a wireless connection 229*b* (e.g., using a Wi-Fi protocol, Bluetooth, z-wave, etc.), the gateway 268, the telecommunications links 216, and the network 214. In addition (or alternatively), the controller 266 may be configured to communicate with the service provider system 206 and/or the user device 208 via the wireless connection 229*c*, the gateway 268, the telecommunications links 216, and the network 214.

In addition, in some of these example embodiments the controller 266 for the sensors 62 of the drain fitting 50 may be part of a ComfortGuard™ installation from White-Rodgers, a Division of Emerson Electric Co. (e.g., as a standalone, aftermarket add-on to the HVAC system 204, etc.). Here, the controller 266 would be in communication with the service provider system 206 and/or the user device 208 via the wireless connection 229*c*, the gateway 268, the telecommunications links 216, and the network 214. As can be appreciated, in such an installation the service provider system 206 is capable of continuously gathering, monitoring, transmitting (as needed) operational information for the HVAC system 204 from the controller 266 and sensors 62 of the drain fitting 50. This allows the user to continuously manage and/or monitor the portion of the HVAC system 204 monitored by the sensors 62 of the drain fitting 50 via the user device 208, and also helps inhibit damage to the HVAC system 204 and structure 211 if fault events occur (by allowing for immediate response).

In other example embodiments, the controller 266 for the sensors 62 of the drain fitting 50 may be provided as an integral part of the HVAC system 204, for example, as part of an indoor unit controller (e.g., an air handler controller, an integrated furnace controller, etc.), etc. Here, the controller 266 may be configured to communicate with the thermostat 230 via the hardwire connection 228. In addition, the controller 266 and/or the thermostat 230 may be configured to communicate with the service provider system 206 and/or the user device 208 via the hardwire connection 228, the gateway 268, the telecommunication links 215, and the network 214. Further, in some aspects, the components of the HVAC system 204 (e.g., the air circulation unit 212, the air conditioner unit 220, the sensors 62, the controller 266, the thermostat 230, etc.) may again be part of a ClimateTalk™ system (from White-Rodgers, a Division of Emerson Electric Co.) that provides a communication protocol (e.g., running on RS-485 hardware layer, etc.) allowing the components to communicate with each other for use in controlling operation of the HVAC system 204 and the components.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A climate control system, comprising:

a conditioning system for controlling air conditions of a space, the conditioning system comprising a thermostat for controlling operation of the conditioning system;

a drain fitting coupling a condensate drain line to an air circulation unit of the conditioning system to thereby allow condensate water to drain from the air circulation unit through the drain line, the drain fitting comprising multiple sensors configured to detect a water level relative to the drain fitting; and a controller coupled to the sensors of the drain fitting;

wherein the sensors are configured to output a signal to the controller indicative of contact with water, wherein the controller is configured to output a signal to the thermostat upon determining that the water level is indicative of the drain line being plugged or blocked, wherein the thermostat is operable to at least partly shut down the conditioning system upon receiving the signal from the controller indicating that the drain line is plugged or blocked, and wherein the multiple sensors include at least three sensors spaced radially around an opening defined by the drain fitting such that at least one of the sensors is positioned above a centerline of the opening and at least one of the sensors is positioned below the centerline of the opening regardless of a rotational position of the drain fitting.

2. The system of claim 1, wherein the thermostat is operable to display a warning message upon receiving the signal from the controller indicating that the drain line is plugged or blocked.

3. The system of claim 1, further comprising a remote service provider system in communication with the conditioning system and configured to monitor operational information of the conditioning system, wherein the controller is configured to output a signal to the remote service provider system upon determining that the water level is indicative of the drain line being plugged or blocked.

4. The system of claim 3, further comprising a user device in communication with the remote service provider system, wherein the remote service provider system is operable to communicate an alert to the user device upon receiving the signal from the controller indicating that the drain line is plugged or blocked.

5. The system of claim 4, wherein the user device is operable to communicate instructions to the remote service provider to at least partly shut down the conditioning system upon receiving the alert.

6. The system of claim 3, wherein the remote service provider system is operable to communicate instructions to the thermostat to at least partly shut down the conditioning system upon receiving the signal from the controller indicating that the drain line is plugged or blocked.

7. The system of claim 1, wherein the sensors are disposed at least partially within a surface of the drain fitting disposed around the opening defined by the drain fitting.

8. The system of claim 1, wherein the controller is configured to indicate that the drain line is plugged or blocked based on the number of sensors that provide an output to the controller indicative of contact with water.

9. A climate control system, comprising:

a conditioning system for controlling air conditions of a space;

a remote service provider system in communication with the conditioning system for monitoring and/or controlling operation of at least part of the conditioning system;

a user device in communication with the remote service provider system;

at least one sensor for detecting a water level in an air circulation unit of the conditioning system; and a controller coupled to the at least one sensor;

wherein the at least one sensor is configured to output a signal to the controller indicative of contact with water, wherein the controller is configured to output a signal to the remote service provider system upon determining that the detected water level in the air circulation unit is indicative of a condensate drain line of the air circulation unit being plugged or blocked, wherein the remote service provider system is operable to communicate an alert to the user device upon receiving the signal from the controller indicating that the condensate drain line is plugged or blocked, and wherein the at least one sensor includes at least three sensors.

10. The system of claim 9, wherein the conditioning system includes a thermostat for controlling operation of at least part of the conditioning system, and wherein the remote service provider system is operable to communicate instructions to the thermostat to at least partly shut down the conditioning system upon receiving the signal from the controller indicating that the condensate drain line is plugged or blocked.

11. The system of claim 9, further comprising a drain fitting coupling the condensate drain line to the air circulation unit of the conditioning system to thereby allow condensate water to drain from the air circulation unit through the drain line, and wherein the at least one sensor is disposed at least partially within a surface of the drain fitting disposed around an opening defined by the drain fitting.

12. The system of claim 9, wherein the at least one sensor is associated with a condensate pan of the air circulation unit.

13. The system of claim 9, further comprising a drain fitting coupling the condensate drain line to the air circulation unit of the conditioning system to thereby allow condensate water to drain from the air circulation unit through the condensate drain line, the drain fitting comprising the at least three sensors, wherein the at least three sensors are spaced radially around an opening defined by the drain fitting such that at least one of the sensors is positioned above a centerline of the opening and at least one of the sensors is positioned below the centerline of the opening regardless of a rotational position of the fitting, and wherein the at least three sensors are disposed at least partially within a surface of the drain fitting disposed around the opening defined by the drain fitting.

14. The system of claim 9, wherein the controller is configured to indicate that the condensate drain line is plugged or blocked based on the number of sensors that provide an output to the controller indicative of contact with water.

15. A climate control system, comprising:

a conditioning system for controlling air conditions of a space, the conditioning system comprising a thermostat for controlling operation of the conditioning system;

a drain fitting coupling a condensate drain line to an air circulation unit of the conditioning system to thereby allow condensate water to drain from the air circulation unit through the drain line, the drain fitting comprising at least three sensors configured to detect a water level relative to the drain fitting, the at least three sensors spaced radially around an opening defined by the drain fitting such that at least one of the sensors is positioned above a centerline of the opening and at least one of the sensors is positioned below the centerline of the opening regardless of a rotational position of the fitting, the at least three sensors disposed at least partially within a surface of the drain fitting disposed around the opening defined by the drain fitting; and a controller coupled to the sensors of the drain fitting;

wherein the sensors are configured to output a signal to the controller indicative of contact with water, and wherein the controller is configured to output a signal to the thermostat upon determining that the water level is indicative of the drain line being plugged or blocked.

16. The system of claim 15, wherein the thermostat is operable to at least partly shut down the conditioning system upon receiving the signal from the controller indicating that the drain line is plugged or blocked.

* * * * *